United States Patent [19]

Sette

[11] Patent Number: 4,598,639

[45] Date of Patent: Jul. 8, 1986

[54] POSTAL METER VALUE SELECTOR SYSTEM

[75] Inventor: Paul R. Sette, Hamden, Conn.

[73] Assignee: Pitney Bowes, Inc., Stamford, Conn.

[21] Appl. No.: 657,698

[22] Filed: Oct. 4, 1984

[51] Int. Cl.[4] ..... B41K 3/08; B41J 1/34

[52] U.S. Cl. ..... 101/110; 101/91

[58] Field of Search ..... 101/110, 111, 91; 235/101

[56] References Cited

U.S. PATENT DOCUMENTS 2,488,143 11/1949 Ronan et al. ..... 101/91
3,589,281 6/1971 Woodhead ..... 101/110
3,882,773 5/1975 Cook et al. ..... 101/110
3,889,594 6/1975 Nickelson ..... 101/111
3,972,281 8/1976 Sams ..... 101/111

*Primary Examiner*—William Pieprz
*Attorney, Agent, or Firm*—David E. Pitchenik; William D. Soltow, Jr.; Albert W. Scribner

[57] ABSTRACT

A postage meter has a print drum with print wheels which are shiftable to select the value of the postage. The positions of the print wheels are controlled by the positions of a plurality of axially displaceable rack gears. The racks are displaced by a pinion which is selectively directly engaged with the racks one at a time and the racks are shifted with respect to a fixed position.

5 Claims, 4 Drawing Figures

POSTAL METER VALUE SELECTOR SYSTEM

BACKGROUND OF THE INVENTION

This invention relates generally to postage meters and is concerned more particularly, but not exclusively, with rotary print drum-type postal meters including the printing mechanisms and the value setting mechanisms thereof.

Postage meters are devices for dispensing value in the form of postage printed on a mailpiece such as an envelope. The term postage meter also includes other similar meters such as parcel post meters. Meters of this type print and account for postage stored in the meter. Mechanisms are provided in the meter to set a particular value of postage to be printed on a mailpiece.

Postage meters in use today typically include a set of four adjacent print wheels, each of which carries print element characters zero through nine. The print wheels can be independently positioned to allow a user to set any amount of postage between $00.00 (for test purposes) and $99.99.

The print wheels of postage meters have in the past generally been manually set by a user through a series of mechanical linkages and levers. Setting the print wheels manually is no problem for users who process relatively little mail on a daily basis. However, for higher volume users, the meter mechanisms have been adapted for automated operation in recent times.

Postage meters have also been developed with electronic accounting systems which has led to the development of printing mechanisms and value setting mechanisms which cooperate with the electronic circuits in a manner to enhance the capabilities of the postage meter.

U.S. Pat. No. 3,978,457 to Check et al, filed Dec. 23, 1974, describes an electronic postage meter in which the printing and value setting mechanism are electronically controlled. Each print wheel is set to position a different postage amount by an independently rotatable gear mechanism. The gear mechanisms are engaged by a master gear one at a time, a master gear being rotatably mounted within a laterally movable carriage. The carriage can be moved to cause the master gear to engage in turn with the gear mechanisms. The carriage is positioned by a pair of solenoids acting through a variable linkage and the master gear is driven by a stepper motor. The print drum is driven by a separate motor. An electronic control system is fully described for operating the value setting and printing mechanisms in correct sequence in accordance with values selected by inputting a keyboard. It will also be noted that the meter may be detachably mounted on a base containing certain mechanical drives although the drives for the setting mechanism are contained in the meter itself.

U.S. Pat. No. 4,050,374 to Check, filed June 21, 1976 describes a setting mechanism for a postage meter similar to that employed in the meter of earlier U.S. Pat. No. 3,978,457 aforesaid in which the solenoids for positioning the master gear carriage are replaced by a stepper motor. It also describes a mechanism for locking the print drum against rotation during value setting. Further aspects and alternatives to the setting mechanism of such postal meter systems are disclosed in U.S. Pat. Nos. 3,965,815 and 3,977,320 to Lupkis et al.

U.S. Pat. No. 4,287,825 to Eckert, Jr. et al, filed Oct. 30, 1979 discloses a setting mechanism like that in U.S. Pat. No. 4,050,374 referred to above with a modified locking mechanism for the print drum during value selection.

U.S. Pat. No. 4,367,676 to Clark, filed May 22, 1981, describes a different approach to value setting. Here a bank of value setting gears equal to the number of print wheels are drivingly connected to respective print wheels one at a time to set the print wheels. A pinion rotated by a stepper motor is shifted from setting gear to setting gear by a tracking mechanism driven by a separate motor which also rotates the print drum at the same time. U.S. Pat. No. 4,140,055 to Lellemand filed June 6, 1977 discloses a print wheel value changing system using a planet wheel transmission device in which an eccentrically mounted pinion meshes with a ring gear within a postage printing drum which supports the postage printing wheel.

U.S. Pat. Nos. 4,301,507 and 4,287,825 are also of interest; the former patent describing in detail an electronic control system for use in an electronic postage meter and the latter patent describing the mechanical aspects of the meter. Pending U.S. application Ser. No. 447,815, entitled "Stand-Alone Electronic Mailing Machine" by D. Buam and A. Eckert, filed on Dec. 8, 1982, assigned to the same assignee as the instant application, discloses further details of electronic control systems, as well as the mechanical aspects, suitable for postage meters and specifically describes a flat bed-type of printer.

Also of interest in this area are U.S. Pat. Nos. 3,965,815 and 3,977,320 which relate to electromechanical setting mechanisms for rotary drum postal meters. Other patents of general interest incude U.S. Pat. Nos. 3,876,870; 3,890,491; 3,892,355; 3,916,361 and 3,949,203 issued to Malavazos et al.

The present invention embodies various improvements to postage meters generally particularly to the printing mechanisms therefor. A novel system is disclosed for the setting of the postage value amounts in postage meters and for driving and operating the meter. The system includes, inter alia, a novel approach to moving the racks which control the value selection for printing on the mailpiece by the postal meter, particularly a system of the type having axially displaceable setting racks.

Different aspects of the invention as set forth herein variously include several advantages over prior art devices. The number of racks or other setting devices and, thus, the number of print devices, is not limited by the setting mechanism. In previous systems, a relatively small number of racks, such as four setting racks, had been used to change the four digits of postage ($00.00).

Aspects of the present invention permit a larger number of setting devices. This enables additinal changeable information, such as date, logos, cities, etc., to be placed on the postal stamp which can be quickly and easily varied. In addition, relatively speedy value setting is possible and relative compactness of the value selection system can be achieved. There is also a large reduction in the number of parts in the system compared with prior art devices with consequent cost reduction achieved.

SUMMARY OF THE INVENTION

The invention is generally concerned with postage meters for printing selected value amounts on a print receiving surface of the kind having a rotatable print drum and a plurality of value print wheels mounted within the print drum, said print wheels each having a plurality of value print elements and being selectively adjustable to align selected value print elements in an operative position in which they are exposed at the surface of the drum. Means is provided for rotating the drum to move the selected value print elements through a printing position to form an imprint on a said print receiving surface. Means is also provided for automatically setting or adjusting the value print wheels to align the selected print elements in accordance with selected print values. In accordance with the invention, the automatic setting or adjustment means comprises a plurality of value selection racks connected to respective value print devices for adjusting same and rack displacement means engageable with said racks one at a time for moving said racks to adjust the associated value print devices, and the value selector racks are shifted with respect to the rack displacement means to selectively engage the racks one at a time with the rack displacement means.

By way of example, in a preferred embodiment of the value selector the rack displacement means comprises a worm and pinion drive mounted within an arcuate or part-annular array of racks with the worm mounted on the inner of three concentric shafts and the pinion mounted on the intermediate shaft, the outer shaft having the print drum mounted for rotation on it. The inner shaft is rotatable alone for rack displacement and the intermediate shaft carrying the pinion is fixed against rotation. The drum is rotatable with the third shaft to effect rack shifting as well as to effect printing.

BRIEF DESCRIPTION OF THE DRAWINGS

In order that the invention may be more readily understood, reference will now be made to the accompanying drawings wherein.

DETAILED DESCRIPTION

Figure 1:
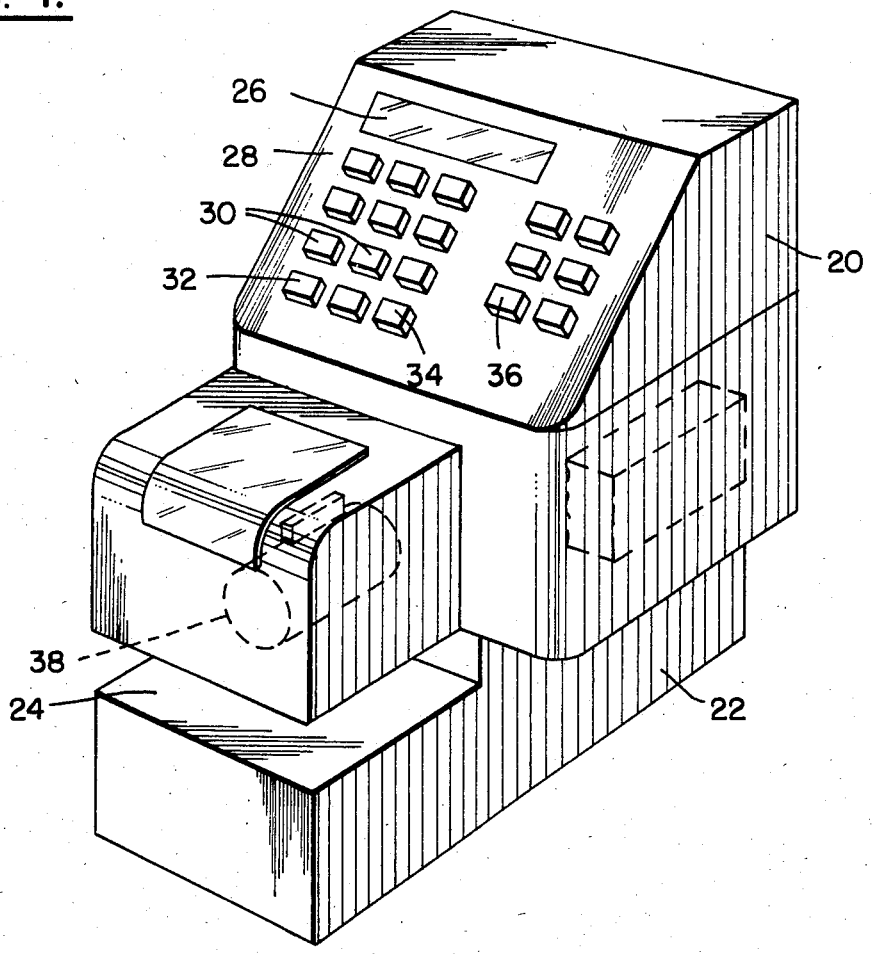
FIG. 1 is a simplified perspective view of a postage meter incorporating apparatus according to the present invention.

Referring to the drawings, particularly FIG. 1, there is shown a postage meter 20 according to the invention which can be removably fixed to a base 22. A slot 24 is provided between the meter 20 and the base 22, at the forward edge thereof, for receiving envelopes or the like and the printing of postage thereon. The postage meter is provided with a display panel 26, preferably an electronic display, as well as a control panel 28. Any suitable type of electronic control system may be used with the rotary value mechanism disclosed herein.

The meter 20 can be suitably removable from the base 22 in the manner disclosed in U.S. Pat. No. 2,934,009, Bach et al, which incorporates a mechanical drive for operation of the printing mechanism in the base. The separability of the meter and base, inter alia, simplifies servicing and transport of the meter for recharging.

The control panel for the postage meter can be any suitable type such as one provided with a numeric or alphanumeric display 26, for example, a conventional multiplexed, seven-segment LED or LCD display. In addition, the control panel can be provided with numeric setting keys 30 and a decimal key 32 for setting the meter to print a desired amount of postage, the amount normally being displayed on the display 26. A clear key 34 may also be provided to clear the display amount in the event, for example, of an erroneous entry. When the displayed amount has been set to the desired value, depression of a set postage key 36 effects setting of the printing mechanism. Printing may be initiated by the insertion of an envelope or the depression of a print key.

The panel may further be provided with a series of keys enabling the selective display of other values on the display 26. For example, keys may be provided for displaying the contents of an ascending register; i.e. the postage used by the meter, a descending register; i.e., the postage for which the meter is still charged, and other desired information. Further, a service switch (not shown) at the back of the meter may be operated to use the keys of the meter for diagnostic and other service function. The meter may be adapted for remote meter resetting as discussed, for example, in U.S. Pat. No. 4,097,923. Further details of these functions are to be found, for example, in U.S. Pat. No. 4,301,507 referred to below.

The printing mechanism includes a print drum 202 mounted in the meter 20 over the slot 24 and having an opening in its periphery through which selected print elements 209 project. For printing the selected print value on an envelope, the drum is rotated to press the print elements against the envelope which is driven through the slot 24 by frictional contact with the drum. The print elements, which are suitably mounted on the peripheries of a series of print wheels 208, are rotated to align the selected value elements for printing in the opening.

Adjustment or setting of the print wheels is effected by a setting mechanism controlled in accordance with selected print values input at the keyboard 28 by means of a suitable control system such as an electronic control system. Suitable electronic control systems are described in U.S. Pat. No. 3,978,457 to Check et al and U.S. Pat. No. 4,301,507 to Soderberg et al.

In this embodiment, the print drum 202 is journaled in bearings 203 in the meter body 206 on a shaft 207. The print wheels 208 are rotated to their adjusted positions in which the selected print elements 209 are exposed at the surface of the drum by a setting mechanism including a rotary value selector 204 shown in FIG. 3 which has a series of linear toothed racks 210 (only one of which is shown) which are moved axially to effect rotation of said print wheels through suitable connections such as spur gears 212. A separate rack 210 is provided for each print wheel so that the number of racks equals the number of print wheels and each rack is connected to a different print wheel. The racks 210 are slideably mounted in the drum 202 and arranged side-by-side in an arcuate or part annular array around a rack displacement device comprising a pinion 214 which can be tracked from rack to rack and is driven by a worm drive 216.

The worm gear 216 is mounted on the end of a shaft 218 concentrically arranged in a tubular shaft 220 on bearings 222. The shaft 220 carries the pinion 214 and is journaled in bearings 224 within the print drum shaft 207.

The shafts 218, 220 and 207 terminate in like gears 226, 228 and 230, respectively, which are arranged side-by-side and driven through respective drive motors, e.g. stepper motors, M1, M2, M3. The drive shafts of the motors M1, M2, M3 are connected to the respective gears 226, 228, 230 by drive gears 232, 234, 236 on the respective drive shafts.

In operation, the motors M1 and M2 are operated synchronously to drive the gears 226 and 228 in unison to rotate the worm 216 and pinion 214 as a unit to shift the pinion 214 from one rack 210 to the next. For displacing a rack, the motor M1 is operated alone to drive only gear 226 so as to rotate pinion 214 in engagement with the rack to adjust the associated print wheel. For driving the print drum through a printing revolution, all three motors are operated synchronously to rotate the drum 202, worm 216 and pinion 214 as a unit whereby the rack displacement pinion fixed relative to the drum so as to prevent it from interfering with the racks during drum rotation.

It will be understood that prior to the print cycle, the pinion is desirably shifted to an inactive position out of contact with any rack. The pinion 214 may be rotated counterclockwise or clockwise, respectively, for advancing the associated rack (to the left as viewed in FIG. 3) to increase the print value of the print wheel 42 being set and for retracting the rack (to the right as viewed in FIG. 3) to decrease the print value.

Throughout the operation of the selector 204, the positions of the racks 210 and the pinion 214 are suitably electronically monitored by any suitable means such as by utilizing two slotted encoder disks and associated optical sensor devices 102 (not shown).

Figure 2:
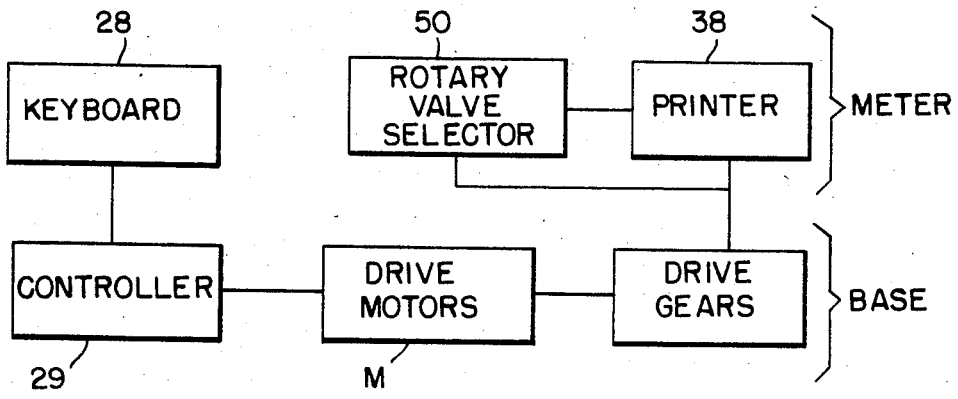
FIG. 2 is a block diagram illustrating the relationship of elements of the postage meter.

In accordance with a feature of this embodiment of the invention, the motors M1, M2, M3 and associated drives for the selector and drum are housed in the base 22 while the selector and drum themselves are mounted in the meter 20 which can be removed from the base. The interface between the base and meter is suitably at the gears 226, 228 and 230. This arrangement is illustrated schematically in FIG. 2 where it is seen that the keyboard 28, the rotary value selector 50 and the print drum 38 are arranged in the meter 20 while the controller 29, the motors M and the associated mechanical drives are all arranged in the base 22.

The operation of the postage meter described above through a complete value selection and print cycle will now be described in an illustrative fashion. It will be assumed that the elements of the meter are all in their home positions with the print wheels all set at zero and the pinion disengaged from all the racks. By way of illustration, it will also be assumed that a postage value of $23.65 is to be set. For the purposes of explanation, it will be assumed that the selector illustrated has five racks 210*a* through 210*e*, each associated with its own print wheel 208. In the following description, the racks 210*a* and 210*b* represent tens and units of dollars, respectively, while racks 210*c* and 210*d* represent tens and units of cents, respectively. It will be understood that the dollar sign and decimal point are permanently positioned at the window in the drum where the aligned elements are exposed. Rack 210*e* respresents any additional information that is desired to be changed, such as the date.

At the beginning of the cycle, the pinion 214 is arranged intermediate the racks 210*a* and 210*c* in its home position and it is assumed the value is "$00.00" on the print wheels 42. With the printer switched on, the user punches in the value amount $23.65 to the keyboard 28 using the keys 30. Once the value amount has been entered and verified on the display 26, the key 36 is depressed to put the value selection cycle into effect. Signals indicative of value amount are processed by the CPU of the controller and signals are sent to the stepper motors M1 and M2 to perform value selection in the following manner with feedback from the encoders (not shown).

First, the stepper motors M1 and M2 are activated to drive gears 226 and 228 in synchronism to effect a precise rotation of shafts 218 and 220 to bring pinion 214 into engagement with rack 210*a*, and then inactivated.

Figure 3:
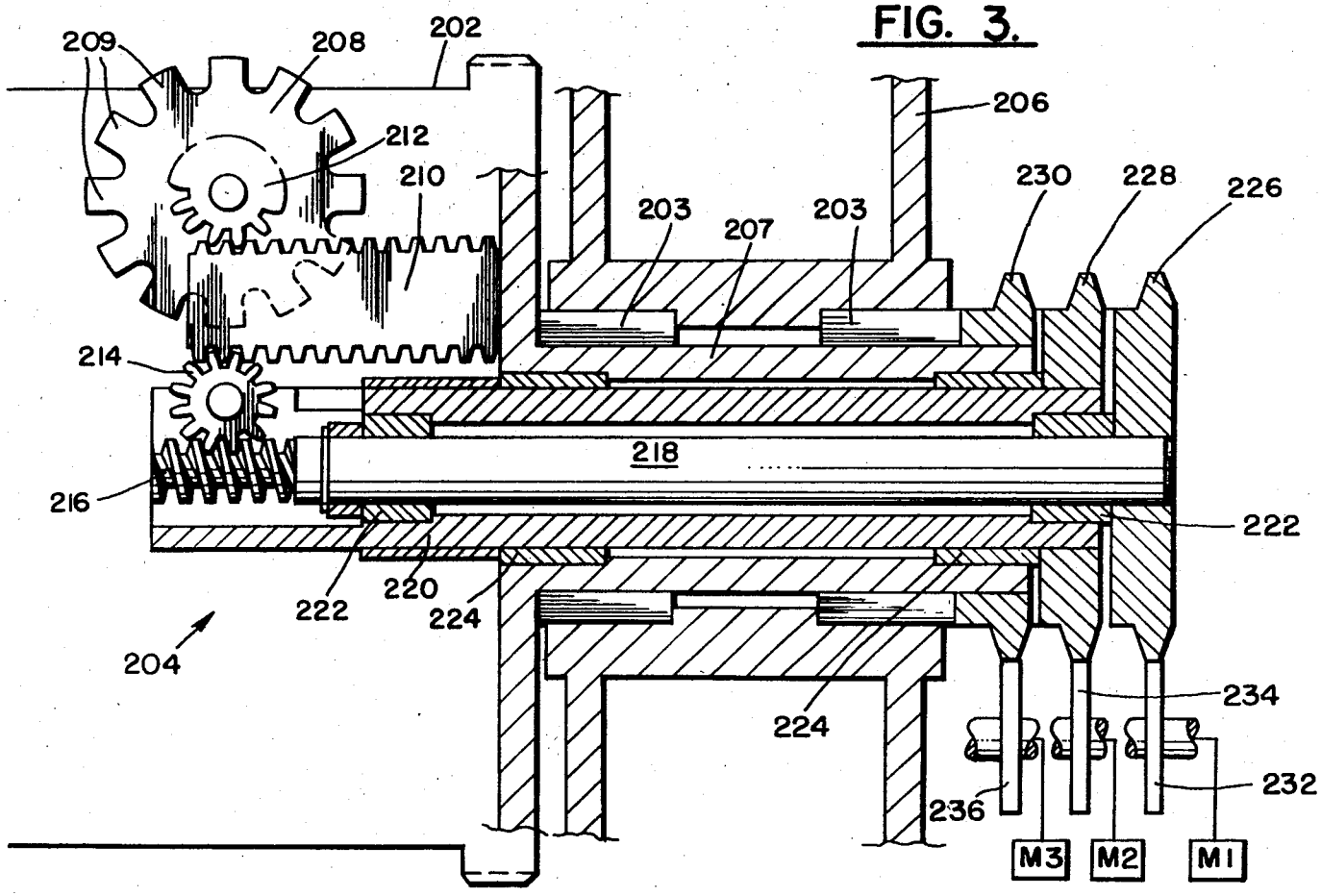
FIG. 3 is an axial section through a rotary print value selector for the postage meter of FIG. 1.

The stepper motor M1 is again activated to drive shaft 218 and rotate worm 216 to effect counterclockwise rotation of pinion 214 to displace the rack 210*a* to the left in FIG. 3 to position the print element "2" of the associated print wheel 208 in the print window of the drum.

The next operation is to track the pinion 214 to the next rack 210*b* to be displaced. To this end, the drive motors M1 and M2 are again activated to drive shafts 218, 220 in synchronism to track the pinion 214 to rack 210*b*, and inactivated. The stepper motor M1 is again activated to rotate the pinion 214 counterclockwise to position the print element "3" of the associated print wheel 208 in the print window of the drum.

The pinion is next tracked around into engagement with rack 210*c* which is connected to the 'tens of cents' print wheel and the pinion 214 rotated until the digit '6' is exposed at the print window.

The pinion 214 is next shifted to the rack 210*d* and rotated in the manner just described to position the digit '5' of the 'cents unit' print wheel in the print window.

The pinion 214 is now moved to the rack 210*e* and, assuming this to be the first operation of the day and a new date has been inputted at the keyboard 28, the pinion 214 will now be rotated to position the rack 210*e* appropriately. In a more versatile form, two, or more racks may be used for data information.

The pinion 214 is now tracked back to its home position intermediate to racks 210*a* and 210*e*.

Following value selection, either in response to insertion of a mailpiece or upon depression of a print key, the three motors M1, M2, M3 activated simultaneously and synchronously to effect print cycling by rotating the drum and selector as a unit, the drum being rotated through a complete revolution to bring the selected print elements against the mailpiece in the slot 28 and imprint the value amount on the mailpiece. The meter is now ready to receive the next value amount by actuation of the setting keys 30.

In this illustration, it is assumed the next value amount required is 45 cents. To set the print wheels to this amount, the rotary selector is operated in the manner described above to perform the following movements. The pinion 214 is first engaged with rack 210*a* to return that 'tens of dollars' print wheel to zero. During displacement of the rack, the shaft 218 is rotated so as to rotate the pinion 214 clockwise causing the rack 210*a* to retract (move to the right in FIG. 3) rather than advance. The pinion 214 is now tracked to rack 210*b* to return the associated print wheel to zero in the manner just described. It is then tracked to rack 210*c* and rotated to retract the rack 210*c* to display the digit '4'. The pinion 214 is next tracked back to its home position, via the 'cents unit' and the date racks 210*d* and 210*e*. However, since these values are unchanged, the pinion 214 does not effect any change in the positions of these racks. Following this, the three motors M1, M2, M3 are again activated together to drive the print drum through its print cycle revolution.

It will be understood that throughout the various selection and print cycles, the angular positions of the shafts 207, 218, 220 and the linear positions of the racks 210 are constantly monitored by the feedback sensors. The sensors continuously feed the movements of the shafts to the controller, being connected to an input port of the controller in the manner described in aforesaid U.S. Pat. No. 3,987,457.

In summary, it will be understood from the foregoing that rack selection is carried out by rotating shafts 218 and 220 together to track the pinion 214 from rack to rack, rack displacement is carried out by rotating shaft 218 alone to rotate pinion 214 on its axis and print cycling is carried out by rotating shafts 218, 220 and 207 together to rotate the selector and drum as a unit with the elements locked together.

Figure 4:
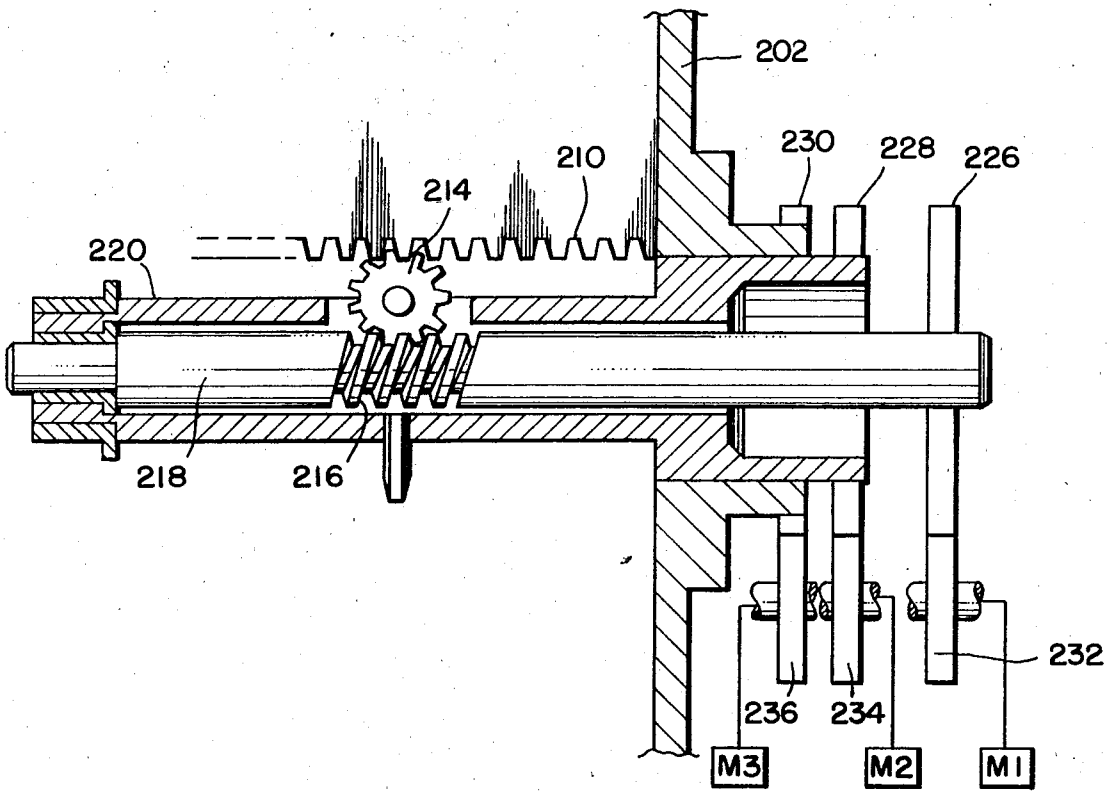
FIG. 4 is an axial section through another embodiment of rotary print value selector.

In modification of the embodiment shown in FIG. 4, the pinion 214 is fixed against rotation about the drum axis during value selection and rack selection is by tracking the racks 210 with respect to the pinions 214. Thus, in this embodiment the shafts 220 and 218 are held against rotation during rack selection, the racks being shifted by small angular movements of the drum 202 itself through gear 230. Thus, for rack selection, only the motor M3 is operated to drive the drum via gear 230 and for rack displacement only motor M1 is operated to drive the worm 216 via gear 226. During the print cycle, all three motors M1, M2, M3 are driven synchronously to drive all three gears 226, 228 and 230 to drive the drum and value selector as a unit.

FIG. 4 shows a further embodiment which is similar to that shown in FIG. 3 and like references are used to designate similar parts. In this embodiment, the bearing arrangements for the shafts 218 and 220 are varied with the worm 216 and pinion 214 mounted intermediate the ends of the shafts 218, 220, respectively.

The embodiment of FIG. 4 may be modified in like manner to that of FIG. 3 to adapt it for rack selection by moving the racks with respect to the rack displacement pinion.

Although various embodiments have been described, it should be understood that modifications and changes may be made to the specific details referred to herein without departing from the scope of the invention.

While the drive motors are preferably stepper motors, other suitable motors, such as d.c. motors, may be used.

A postage meter as described herein may incorporate various accessory devices, such as an inker for the print elements and a gummed label mechanism which dispenses a gumed label to receive an imprint for use where the mailpiece is too bulky to be inserted in the slot 24. Further, a meter lockdown may be provided to lock the meter to the base upon failure of the system so that the meter cannot be removed or tampered with. A lock down lever, which exists on standard, commercially-available, postal meters is driven in a suitable fashion, such as by a motor, upon failure of the system.

This invention is disclosed in the context of a postal meter, however, other types of meters and devices may have the invention applied thereto with equal value. Other such meters can include parcel service devices, tax stamp devices, check writing devices, etc.

The detailed description herein concentrates on those aspects of a postal meter and its operation which pertains to the principal improvements over the prior art. Aspects of the postal meter system described in a more general manner may be of any well known conventional construction.

It should be understood that the above described embodiments of the invention are illustrative only and that modifications thereof may occur to those skilled in the art. Accordingly, this invention is not to be regarded as limited to the embodiments disclosed herein, but is to be limited only as defined by the appended claims.

I claim:

1. A postage meter for printing selected value amounts on a print receiving surface, comprising:

a support, a plurality of value print devices mounted on said support, said devices each having a plurality of value print elements and being selectively movable to align selected value print elements, means for driving said support to move selected value print elements through a printing position to form an imprint on a said print receiving surface, a plurality of racks connected to respective value print devices for adjusting same and rack displacement means engageable with said racks one at a time for displacing said racks to adjust the associated value print devices, means for shifting said racks with respect to said rack displacement means for engaging said racks with said rack displacement means one at a time, and means for driving said rack displacement means and said rack shifting means.

2. A postage meter as defined in claim 1 in which said racks are axially displaced by said rack displacement means.

3. A postage meter as defined in claim 1 in which said support comprises a rotatable print drum and said value print devices comprise print wheels which are mounted within said drum and are selectively adjustable to align selected print elements in an operative position in which they are exposed at the surface of the drum.

4. A postage meter for printing selected value amounts on a print receiving surface, comprising:

a rotatable print drum, a plurality of value print wheels mounted within the print drum and each having a plurality of value print elements, said print wheels being selectively adjustable to align selected print elements in an operative position in which they are exposed at the surface of the drum, means for rotating said print drum to move the selected value print elements through a printing position to form an imprint on a said print receiving surface, a plurality of axially displaceable racks connected to respective value print devices for adjusting same, rack displacement means engageable with said racks one at a time for moving said racks to adjust the associated value print devices, said racks being disposed in an annular array around said rack displacement means, means for shifting said racks with respect to said rack displacement means for engaging said racks with said rack displacement means one at a time, and means for driving said rack displacement means and said rack shifting means.

5. A postage meter as defined in claim 4 in which said rack displacement means comprises a worm and pinion drive mounted within said array with said worm mounted on an inner of three concentric shafts and said pinion mounted on the intermediate shaft, the outer shaft having said print drum mounted for rotation thereon, and in which said inner shaft is rotatable for rack displacement, said intermediate shaft carrying said pinion is fixed against rotation, and said drum is rotatable to effect said rack shifting in addition to being rotatable for effecting printing.

* * * * *